US005943896A

United States Patent [19]

Rosenthal et al.

[11] Patent Number: 5,943,896

[45] Date of Patent: Aug. 31, 1999

[54] METHOD OF INFLUENCING THE STRIP CONTOUR IN THE EDGE REGION OF A ROLLED STRIP

[75] Inventors: Dieter Rosenthal, Niederfischbach; Jürgen Seidel, Kreuztal, both of Germany

[73] Assignee: SMS Schloemann-Siemag Aktiengesellschaft, Dusseldorf, Germany

[21] Appl. No.: 09/074,127

[22] Filed: May 7, 1998

[30] Foreign Application Priority Data

May 8, 1997 [DE] Germany ..... 197 19 318

[51] Int. Cl.[6] ..... B21B 39/20

[52] U.S. Cl. ..... 72/252.5; 72/247; 72/366.2

[58] Field of Search ..... 72/252.5, 247, 72/366.2

[56] References Cited

U.S. PATENT DOCUMENTS

| | | | |
|---|---|---|---|
| 4,910,988 | 3/1990 | Ikeda et al. | 72/247 |
| 5,174,144 | 12/1992 | Kajiwara et al. | 72/252.5 |
| 5,640,866 | 6/1997 | Satoh et al. | 72/252.5 |
| 5,655,397 | 8/1997 | Satoh | 72/247 |
| 5,697,244 | 12/1997 | Seidel | 72/252.5 |

FOREIGN PATENT DOCUMENTS

| | | | |
|---|---|---|---|
| 0276743 | 7/1992 | European Pat. Off. . | |
| 2260256 | 8/1979 | Germany . | |
| 3038865 | 12/1982 | Germany . | |
| 2206912 | 4/1984 | Germany . | |
| 58-209402 | 12/1983 | Japan | 72/252.5 |
| 6-285518 | 10/1994 | Japan | 72/252.5 |

*Primary Examiner*—Joseph J. Hail, III
*Assistant Examiner*—Ed Tolan
*Attorney, Agent, or Firm*—Friedrich Kueffner

[57] ABSTRACT

A method of influencing the strip contour in the edge region of a rolled strip in which by superimposing a conventional CVC contour the harmful side effect of a unilaterally narrowing roll on the body portion of the roll gap is compensated. Special CVC rolls are used as work rolls for influencing the strip contour in the edge areas. The special CVC roll for influencing the strip contour in the edge area is a roll with a profile, which, starting from a tapered end, has the steadily changing diameter differences of a continuously variable crown, which, in accordance with the invention, is profiled in axial direction in such a way that during its axial displacement the resulting undesirable component of the effect of the conical taper, i.e., the change of the elastic behavior of the roll set, is compensated, wherein this occurs especially to such an extent that additional conventional adjusting measures, such as redistribution of the rolling force or roll bending, are sufficient for maintaining the desired geometry of the roll gap over a wide range of a rolling schedule.

6 Claims, 6 Drawing Sheets

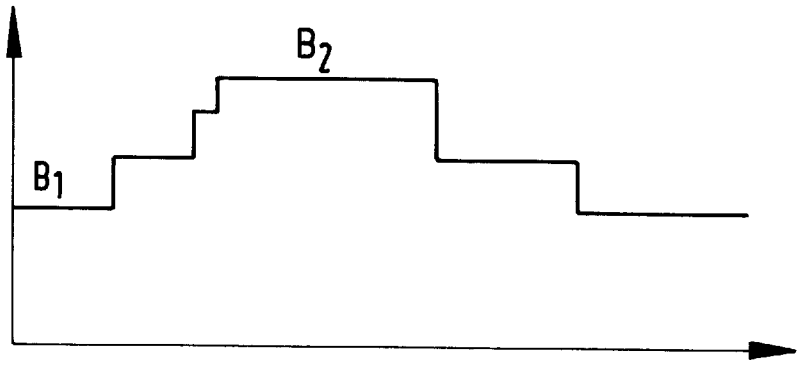
FIG. 3.1
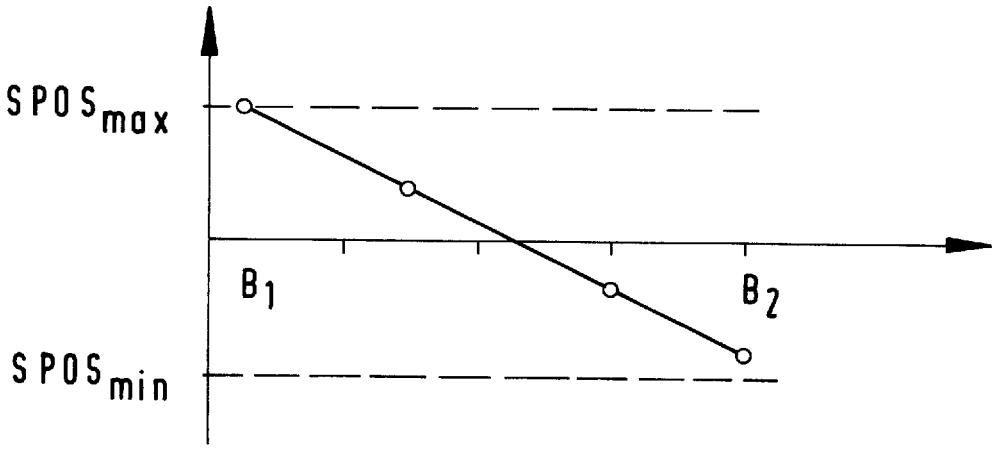
FIG. 3.2
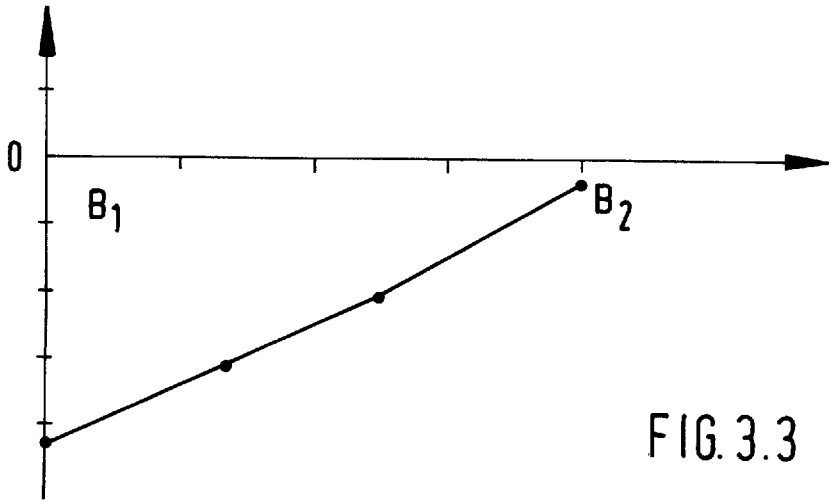
FIG. 3.3

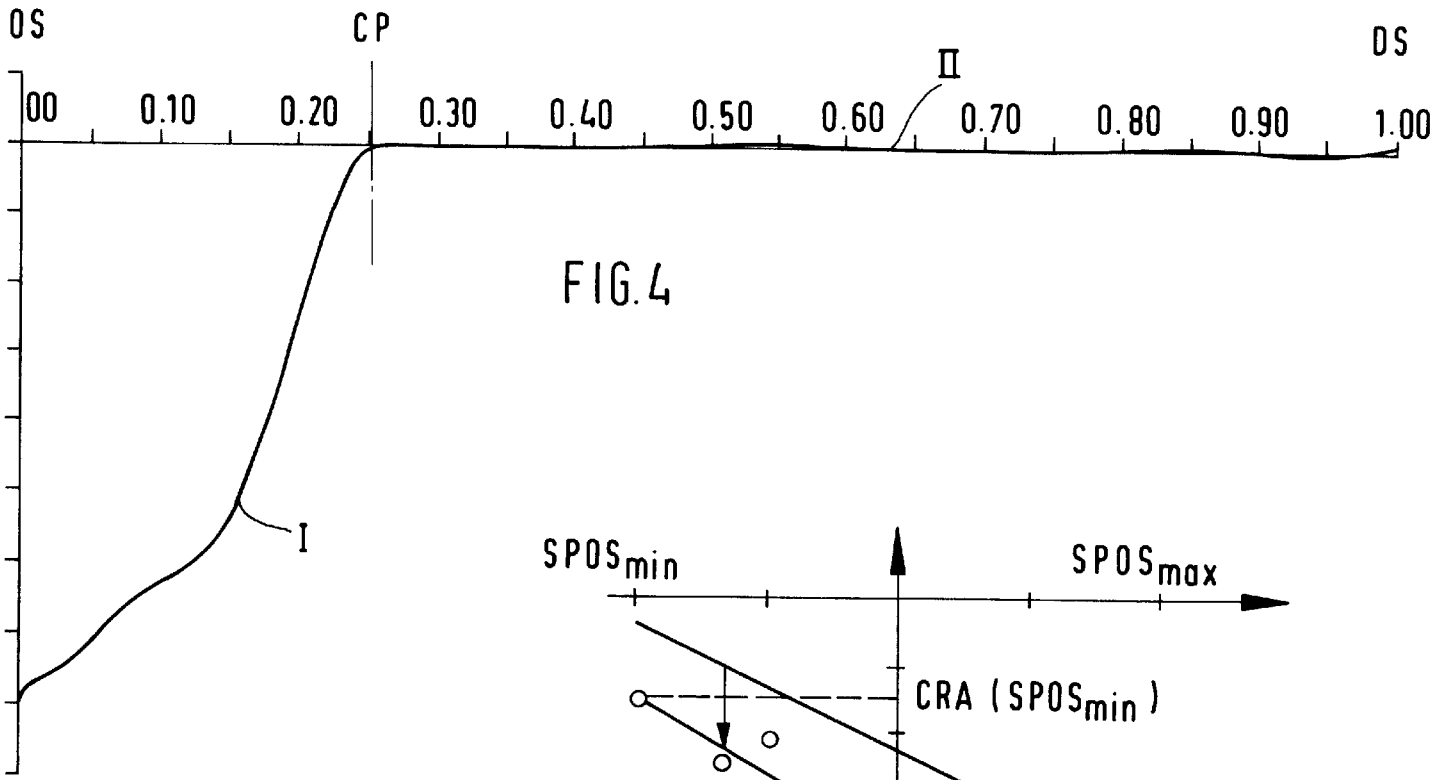
FIG. 4
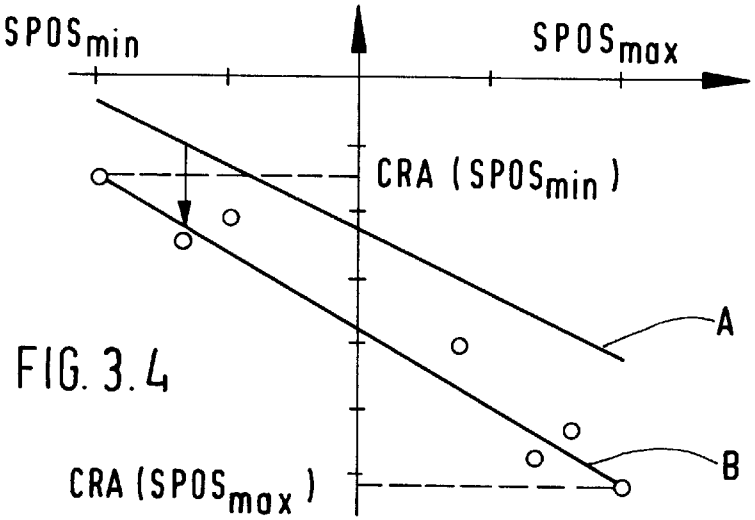
FIG. 3.4

METHOD OF INFLUENCING THE STRIP CONTOUR IN THE EDGE REGION OF A ROLLED STRIP

BACKGROUND OF THE INVENTION

1. Field of the Invention

The present invention relates to a method of influencing the strip contour in the edge region of a rolled strip in which by superimposing a conventional CVC contour the harmful side effect of a unilaterally narrowing roll on the body portion of the roll gap is compensated.

2. Description of the Related Art

When rolling flat strips, the conventional tapered roll with unilateral conical shape serves to influence the strip contour in the edge area of a rolled strip. Consequently, the tapered portion of the work roll is positioned in the vicinity of the strip edge in such a way that the tapered portion follows the strip edge.

Especially in a hot-rolling program, strips of different widths are rolled and the rolling schedules are increasingly put together more freely. In addition, when used in a cold rolling train, it is desired to use, if possible, only one roll type for different rolling stock widths and rolling conditions.

When using the conventional tapered roll, edge conditions result at various widths, wherein the narrowing roll end is pushed more or less far underneath the back-up roll, while the back-up roll remains unchanged in its horizontal position. Because of the different frictional engagement between the work roll and the back-up roll in axial direction, changes occur with respect to the load distribution as well as flattening between back-up roll and work roll as well as the bending behavior of the roll set and, thus, the profile of the roll gap is influenced. This results in undesirable profile shapes and non-planarities of the rolling stock. In addition, other influencing values, such as, rolling force, thermal crown, etc., additionally influence the elastic behavior of the entire roll set.

Therefore, in order to ensure the strip quality or strip planarity, it is necessary to use additional adjusting means, such as work roll bending means or rolling force redistributing means. However, these measures known in the prior art frequently are not sufficient for meeting the increased requirements especially with respect to the planarity also under extreme edge conditions. When manufacturing hot-rolled strip, these requirements are particularly the ability of putting together rolling schedules with more flexibility, wherein, in addition to increased thicknesses and material changes, especially sudden jumps toward narrow and wide strips are desired (mixed rolling).

It is known from DE 30 38 865 C1 to compensate changes of the thermal crown and the work roll wear by suitable adjusting means, such as displacement means and/or bending means, for example, CVC displacement (continuously variable crown displacement) or a suitable cooling.

For controlling the camber and/or edge drop of rolled strip, it is known from EP 0 276 743 B1 to adjust the horizontal displacement of the work rolls and the bending forces acting on the work rolls of a group of roll stands of a tandem rolling mill arranged upstream in accordance with the rolling conditions including the width of the strips.

DE 22 06 912 C3 proposes in six-high stands to construct the intermediate rolls in adaptation to the rolling stock width in such a way that one end of the effective roll body of the upper intermediate roll is located in the area of one rolling stock edge and the opposite end of the effective roll body of the lower intermediate roll is located in the region of the lower rolling stock edge, so that each work roll has an end portion which is free of pressure from the corresponding intermediate roll, wherein roll bending devices act on the ends of the work rolls. The rolls are ground with symmetrical cambers in the conventional manner, or roll bending devices are provided. An end portion of each intermediate roll is constructed so as to be conically narrowing over a relatively short length, which has the disadvantage that a sudden change of the load distribution occurs in the area of the transition from the effective roll body to the conical portion.

DE 22 60 256 C2 discloses a roll stand with devices for axially displacing the work rolls in opposite directions when changes of the rolling stock width occur, so that always one end of the work surface of a work roll is held between a rolling stock edge and the end of the corresponding back-up roll. Moreover, intermediate rolls are provided, wherein the upper intermediate roll is displaceable in the same direction as the lower work roll and the lower intermediate roll is displaceable in the same direction as the upper work roll. Also in this case, only a conical narrowing of the ends of the intermediate rolls is provided, which has the disadvantageous effects described above.

SUMMARY OF THE INVENTION

Therefore, starting from the prior art discussed above, it is the object of the present invention to provide a method for making it possible to determine a roll shape which is capable of compensating the influence of an axial displacement of a roll with tapered end on the elastic behavior of the roll set which produces an undesirable change of the roll gap of the roll bodies, without requiring expensive devices or measures.

In accordance with the present invention, special CVC rolls are used as work rolls for influencing the strip contour in the edge areas.

In accordance with the present invention, a special CVC roll for influencing the strip contour in the edge area is understood to be a roll with a profile, which, starting from a tapered end, has the steadily changing diameter differences of a continuously variable crown, which, in accordance with the invention, is profiled in axial direction in such a way that during its axial displacement the resulting undesirable component of the effect of the conical taper, i.e., the change of the elastic behavior of the roll set, is compensated, wherein this occurs especially to such an extent that additional conventional adjusting means and measures, such as redistribution of the rolling force or roll bending, are sufficient for maintaining the desired geometry of the roll gap over a wide range of a rolling schedule, with the final object of avoiding undesired profile shapes and non-planarities.

The difficulties described above, particularly during rolling of a schedule with rolled strips having different widths, can be substantially reduced by using this special CVC roll.

The required displacement positions shown in FIG. 3.2 result inevitably from the rolling schedule as it is shown, for example, in the diagram of FIG. 3.1; this is because the tapered portion of the work roll always follows the strip edge.

By using an off-line computation, the invention makes it possible to compute the effects of the conical taper between the back-up roll and the work roll. Moreover, the corresponding work roll crown for compensating this effect can be determined. The crown can be assigned to different strip widths or different displacement positions in accordance with the off-line computation. This computation takes place in accordance with the equation:

$$K_1(B)\cdot\Delta\ D(SPOS)/2=K_2(B)\cdot\Delta\ AW\text{-Crown}(B)$$

The AW-Crown required for different strip widths results from equating the effect of the conical taper and the effect of the work roll crown:

$$\Delta AW-Crown(B)=\frac{K_1(B)}{K_2(B)}\cdot\frac{\Delta D(SPOS)}{2}$$

wherein

Δ D (SPOS) is the diameter difference of the unilaterally tapered roll according to FIG. 4 in the area of the contact between work roll and back-up roll, $K_1$ (B) is the difference quotient for the effect of the conical taper between the back-up roll and the work roll, and $K_2$ (B) is the difference quotient for the work roll crown.

In accordance with a further development of the method of the present invention, it is provided to take into consideration, in addition to the compensation of the effect of the conical taper, additional effects which depend on the width of the rolling stock and the corresponding displacement positions of the work rolls and which result from the rolling schedule, such as intended profile of the rolling stock, thickness and strength, as well as the resulting rolling force level.

The method further provides that by adding both effects the total CVC offset of the work roll required for the compensation of the effects is determined.

Finally, the method according to the present invention also provides that the shape of the special CVC roll is developed using the following work steps:

selecting the tapered portion of the work roll, determining the CVC-offset and representing the results in the form of two graphic diagrams, forming the graphic sum of both diagrams, and optimizing the conical portion of the total roll contour or the diameter difference of the work roll in a shape to be ground for the use of the work roll.

The use of this special CVC roll has a positive effect on the stand behavior and the strip travel. The work roll bending remains within the permissible range and at least for the most part does not have to carry out presetting tasks and, thus, is available for on-line control, which also positively influences the strip quality.

In accordance with another feature of the present invention, in which the determined shape of the roll includes a conventional CVC portion and a special portion, the shape is described by means of polynom functions for a portion before a cut point and a portion after the cut point, and wherein a steady transition exists at the cut point with respect to the function value and inclination between the two polynom functions.

In accordance with another feature, the roll is described by providing a sequence of points of length coordinates and diameter coordinates.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 3.1 is a diagram showing a rolling schedule with different width steps over a number of coils;

FIG. 3.2 is a diagram showing displacement positions for various strip widths;

FIG. 3.3 is a diagram of the required AW-Crown for compensating the effect of the conical taper between work rolls and back-up rolls;

FIG. 3.4 is a diagram showing characteristic curves for an optimum CVC-offset;

FIG. 4 is a diagram showing the profile of a tapered portion of an upper work roll;

DESCRIPTION OF THE PREFERRED EMBODIMENTS

Figure 1:
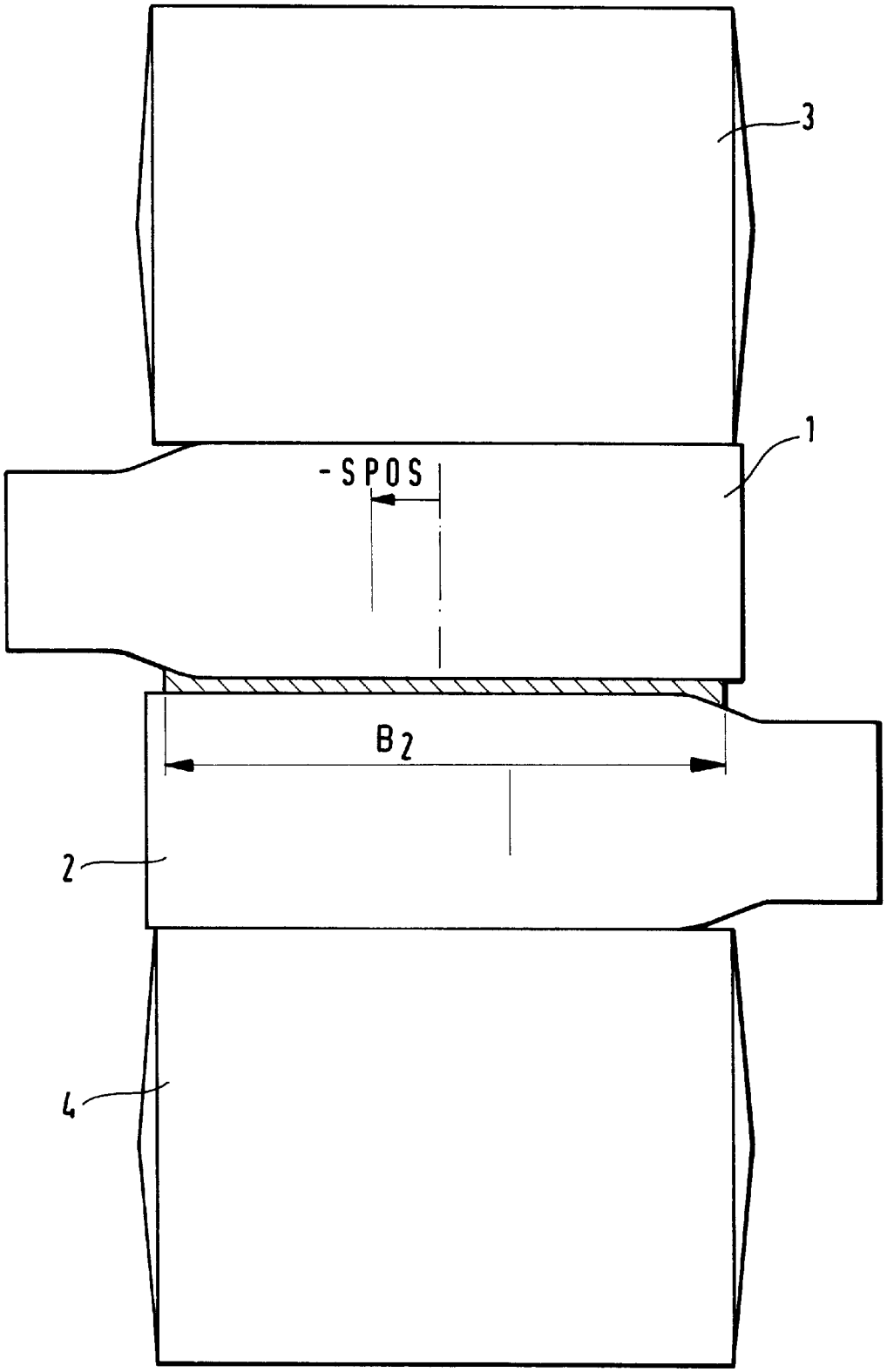
FIG. 1 is a schematic illustration of a roll set with two work rolls and back-up rolls each in the unloaded state and with a rolling width $B_2$.
Figure 2:
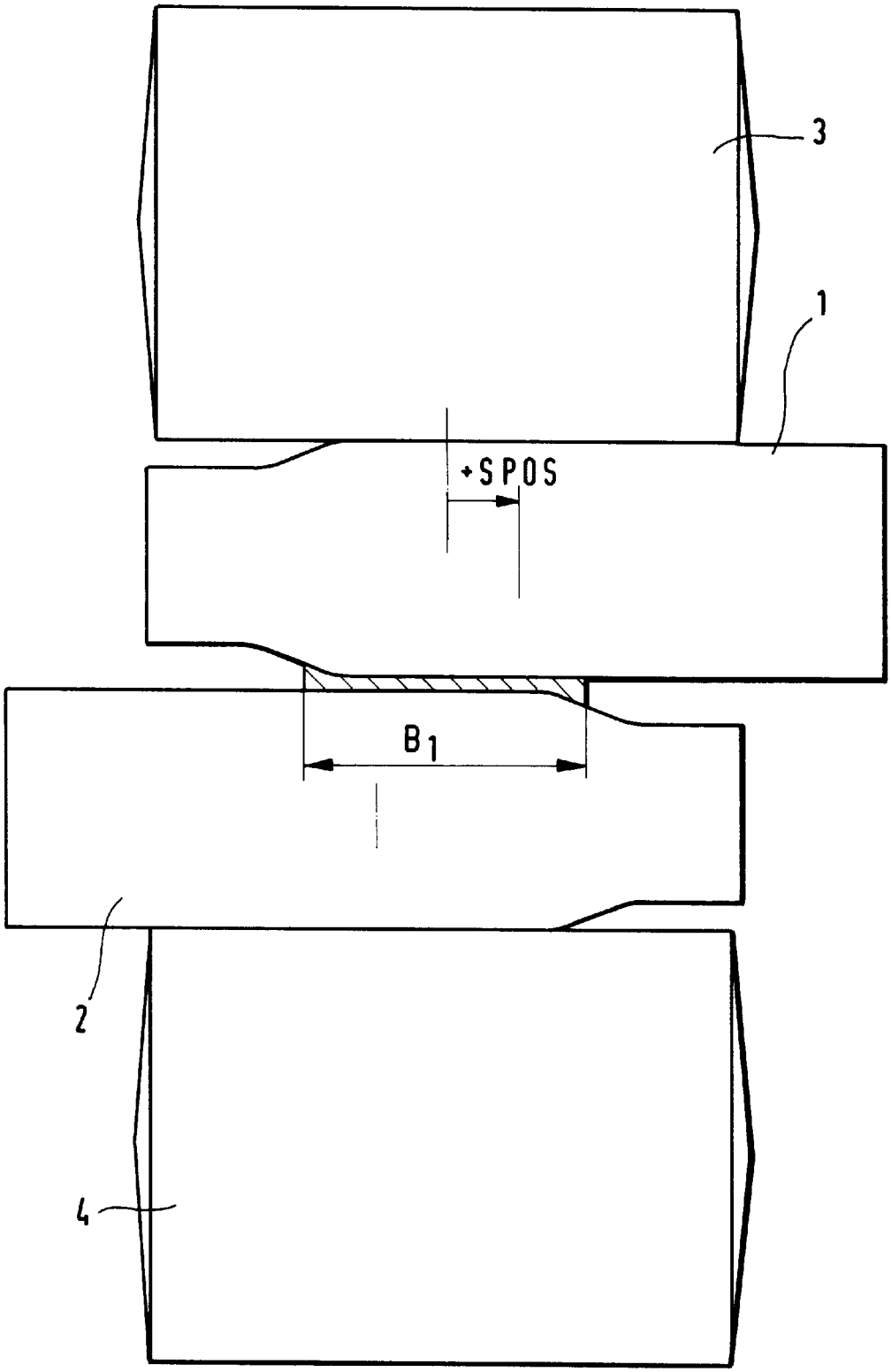
FIG. 2 is a schematic view of a roll set according to FIG. 1, shown in the unloaded state, but with a narrower rolling width $B_1$.

FIGS. 1 and 2 of the drawing show roll sets in the unloaded state and in different displacement positions SPOS, wherein the tapers of the work rolls 1 and 2 are directed toward the rolled strip edges. It can be seen that the roll displacement only affects the work rolls 1 and 2, but not the back-up rolls 3 and 4.

FIG. 3.1 shows the rolling schedule over a number of coils with widths of between $B_1$ and $B_2$ corresponding to FIGS. 1 and 2, wherein the width is plotted on the ordinate and the coil number is plotted on the abscissa.

The corresponding displacement positions for the various strip widths are shown in FIG. 3.2 in the form of a diagram. The displacement positions on the ordinate occur between maximum plus $SPOS_{max}$ and maximum minus $SPOS_{min}$, as measured from the zero line. These displacement positions include widths of the rolled strip of between $B_1$ and $B_2$.

The work roll crown or AW-Crown on the ordinate required for compensating the effect of the conical taper between the work roll AW and back-up roll STW on the roll gap is illustrated as a diagram in FIG. 3.3, and specifically on the abscissa for rolling stock widths of between $B_1$ and $B_2$.

FIG. 3.4 shows characteristic curves for the CVC-offset for compensating the effect of the conical taper between the work rolls 1 and 2 and the back-up rolls 3 and 4. The ordinate represents the work roll crown and the abscissa represents the work roll displacement position. The upper characteristic line A refers exclusively to the required CVC-offset for compensating the effect of the conical taper between AW and STW. The lower characteristic curve B represents the optimum total CVC-offset when taking into consideration additional influence values as set forth in the claims.

FIG. 4 is a diagram showing in portion I the required profile of the upper work roll 1 with the tapered portion between the roll end and the cut point CP. The contour in the portion II is comparatively flat. The cut point CP is set in dependence on the width components of the rolling schedule or the range of widths being used. The steepness of the tapered portion results particularly from the outermost rolling force and the strip thickness of the respective stand. OS denotes the operator side of the roll and DS denotes the drive side of the roll. The roll profile is shown on the ordinate in relation to the roll diameter; the dimensionless length of the roll is represented on the abscissa.

Figure 5:
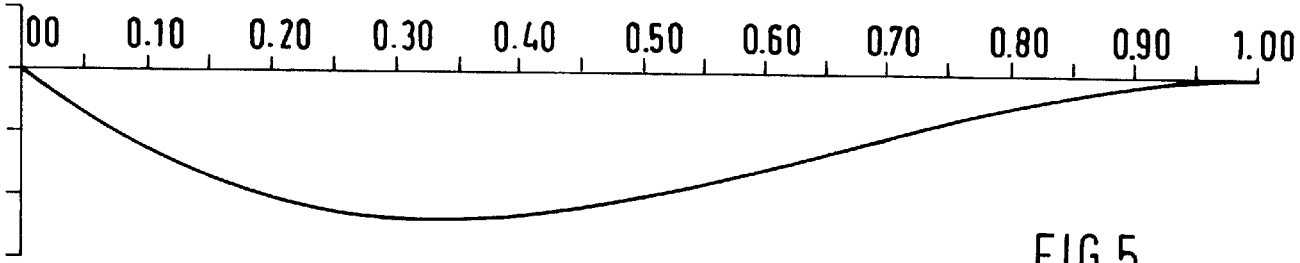
FIG. 5 is a diagram showing the shape of a CVC-offset.

FIG. 5 shows the shape of a CVC-offset with an adjusting range for the work roll crown between CRA($SPOS_{min}$) and CRA($SPOS_{max}$) corresponding to the characteristic curve B in FIG. 3.4. The illustrated curve refers exclusively to the CVC contour, with the axes of coordinates being the same as in FIG. 4.

Figure 6:
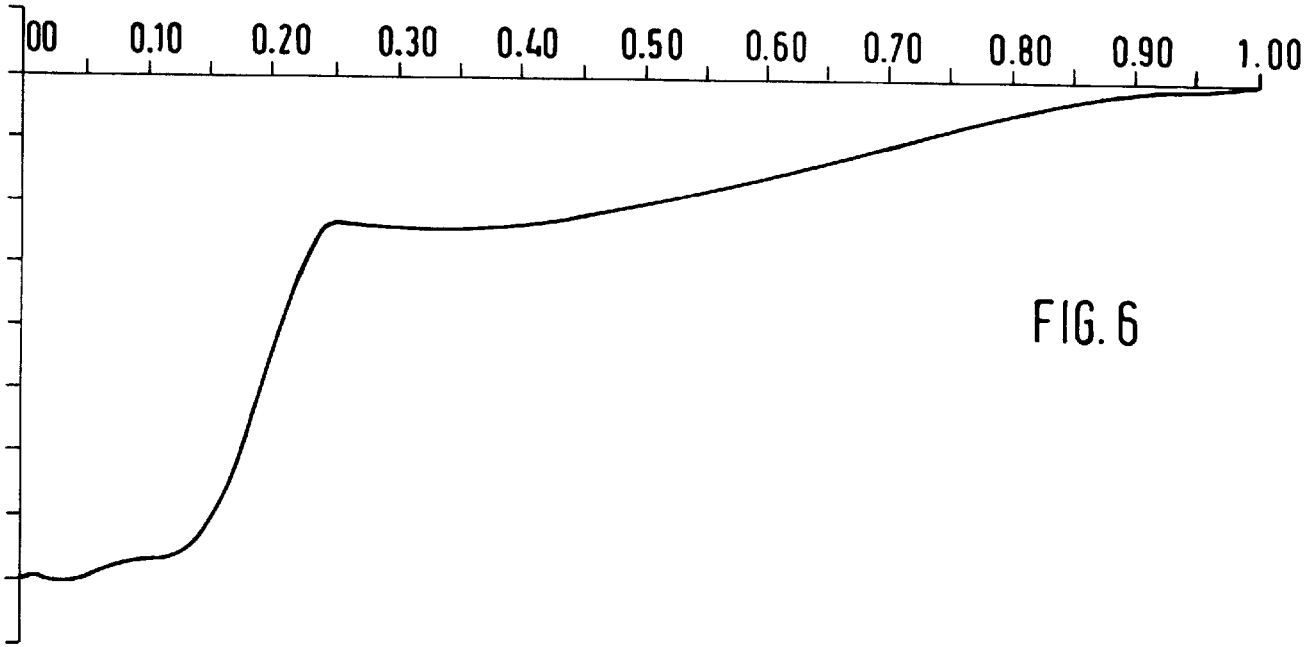
FIG. 6 is a diagram of the sum of the tapered portion and the CVC-offset.

FIG. 6 shows a profile which is composed of the sum of the tapered portion and the CVC-offset, with the axes of coordinates being the same as in FIG. 4.

Figure 7:
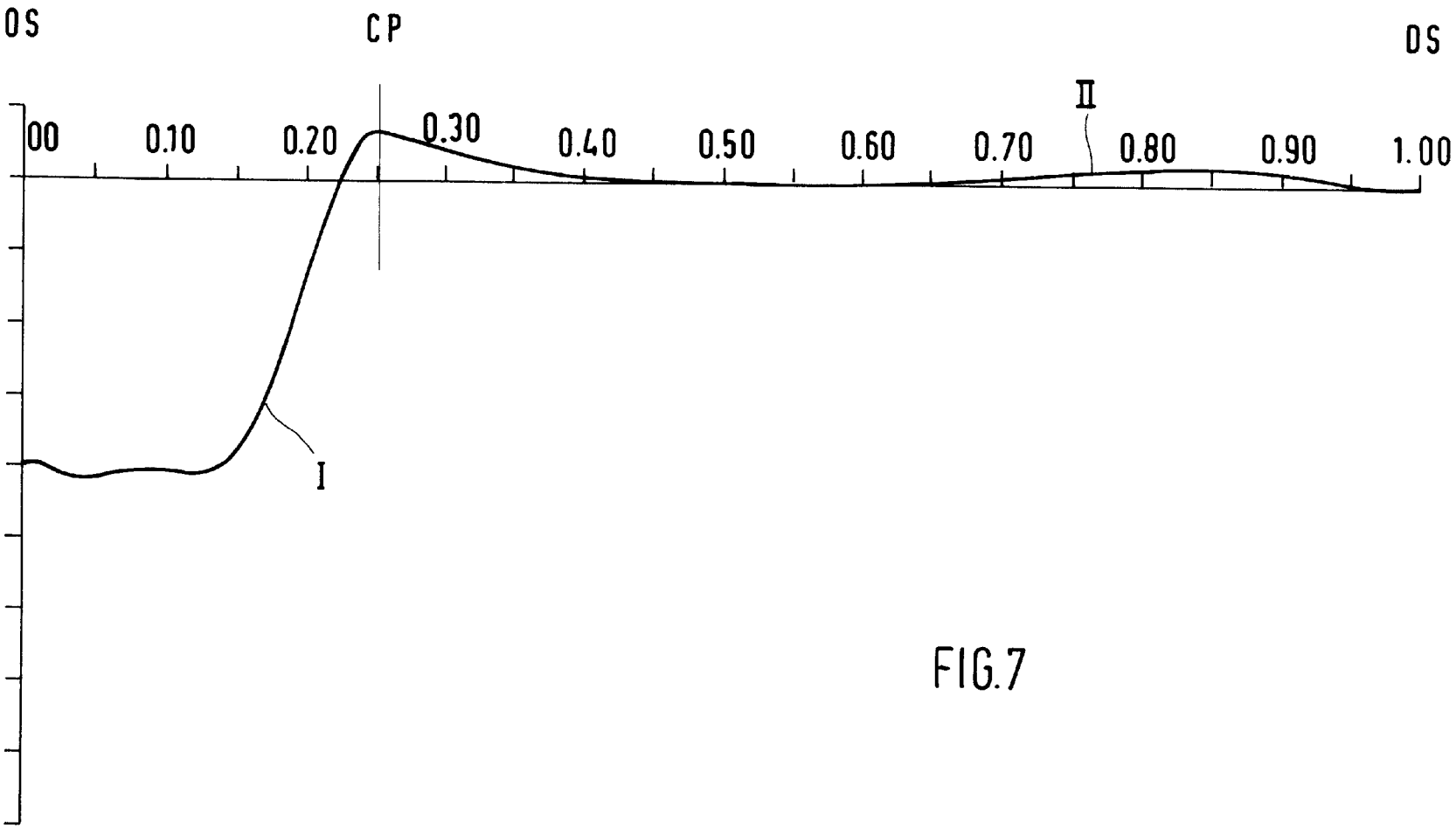
FIG. 7 is a diagram showing the sum of the tapered portion and the CVC-offset after optimizing the conical portion of the total roll contour.

FIG. 7 shows the profile curve with the portions I in front of the cut point CP and II after the cut point CP, as a sum of the tapered portion and the CVC-offset after optimization of the tapered body portion, with the axes of coordinates being the same as in FIG. 4.

While specific embodiments of the invention have been shown and described in detail to illustrate the inventive principles, it will be understood that the invention may be embodied otherwise without departing from such principles.

We claim:

1. A method of influencing a strip contour in an edge area of a rolled strip rolled in a roll gap formed by work rolls of a roll stand, comprising compensating by superimposing a conventional CVC contour a harmful side effect of a unilaterally tapered roll on a body portion of the roll gap, further comprising using unilaterally tapered rolls as work rolls, and determining a crown of the work rolls by an off-line computation, further comprising computing the crown required for compensating the effect of the unilateral taper in accordance with different rolled strip widths and corresponding displacement positions of the work rolls in accordance with the equation $$K_1(B)\cdot\Delta\ D(SPOS)/2=K_2(B)\cdot\Delta\ AW\text{-Crown}(B)$$

wherein the crown required for different strip widths results by equating both effects:

$$\Delta AW - Crown(B) = \frac{K_1(B)}{K_2(B)} \cdot \frac{\Delta D(SPOS)}{2}$$

and wherein

Δ D (SPOS) is a diameter difference of a unilaterally tapered roll in an area of contact between the work roll and a back-up roll, $K_1$(B) is a difference quotient for the effect of the conical taper between back-up roll and work roll and, $K_2$(B) is a difference quotient for the crown of the work roll.

2. The method according to claim 1, comprising, in addition to compensating for the edge effect, taking into consideration additional effects which depend on the width of the rolling stock and corresponding displacement positions of the work rolls and which result from a rolling schedule, such as intended profile of the rolling stock, thickness and strength thereof, as well as a resulting rolling force level.

3. The method according to claim 2, comprising determining a total CVC-offset required for compensating the edge effect and the additional effects by adding the edge effect and the additional effects.

4. The method according to claim 1, comprising determining a shape of the special CVC roll using the following work steps:

selecting the tapered portion of the work roll in dependence on a width configuration of a rolling schedule as well as expected rolling forces, strip thicknesses, etc., determining the CVC-offset and representing the results in the form of two graphic diagrams, forming a graphic sum from both diagrams, optimizing the tapered portion of the total roll contour or the diameter difference of the work rolls in a shape to be ground for the use of the work rolls.

5. The method according to claim 1, wherein the determined shape of the roll includes a conventional CVC portion and a special portion, describing the shape by means of polynom functions for a portion before a cut point and a portion after the cut point, wherein a steady transition exists at the cut point with respect to the function value and inclination between the two polynom functions.

6. The method according to claim 1, comprising describing the roll by providing a sequence of points of length coordinates and diameter coordinates.

* * * * *